US005222151A

United States Patent [19]

Nagayoshi et al.

[11] Patent Number: 5,222,151

[45] Date of Patent: Jun. 22, 1993

[54] EARPHONE

[75] Inventors: Atsushi Nagayoshi; Kazunori Kouno, both of Osaka, Japan

[73] Assignee: Matsushita Electric Industrial Co., Ltd., Osaka, Japan

[21] Appl. No.: 755,763

[22] Filed: Sep. 6, 1991

[30] Foreign Application Priority Data

Sep. 7, 1990 [JP] Japan ..... 2-237526

[51] Int. Cl.[5] ..... H04R 25/00

[52] U.S. Cl. ..... 381/187; 381/183; 381/68.6

[58] Field of Search ..... 381/68, 68.6, 187, 183, 381/74, 25

[56] References Cited

U.S. PATENT DOCUMENTS

| | | | |
|---|---|---|---|
| 4,403,120 | 9/1983 | Yoshimi | 381/183 |
| 4,736,435 | 4/1988 | Yokoyama et al. | 381/188 |
| 4,965,838 | 10/1990 | Kamon et al. | 381/183 |
| 4,972,492 | 11/1990 | Tanaka et al. | 381/68.6 |

*Primary Examiner*—Jin F. Ng
*Assistant Examiner*—Huyen D. Le
*Attorney, Agent, or Firm*—Pollock, VandeSande & Priddy

[57] ABSTRACT

An earphone has a case housing an electroacoustic transducer, the case being adapted to be put in the concha of the auricle of an ear. The case is of an elliptical shape so that it can snugly fit in the concha without under pressure imposed on the ear.

10 Claims, 3 Drawing Sheets

EARPHONE

BACKGROUND OF THE INVENTION

1. Field of the Invention

The present invention relates to an earphone comprising a case that houses an electroacoustic transducer, the case being adapted to be put in the hollow or concha of the flap of an ear known as an auricle.

2. Description of the Prior Art

One earlier earphone has a sound outlet to be inserted into the external auditory meatus of an ear in use. Modern earphones have a case housing an electrostatic transducer, the case being shaped so that it is simply put in the concha of an ear flap or auricle. The case is not inserted into the external auditory meatus of an ear, and hence does not make the user feel uncomfortable. Furthermore, the electroacoustic transducer housed in the case may be of a large size for improved sound quality particularly in a low frequency range. For these reasons, the modern earphone design has gained almost exclusive popularity among earphone users.

One recent earphone disclosed in Japanese Patent Publication No. 64-4398 comprises a housing having an external ear engaging region on the outer periphery of a front portion of the housing, the external ear engaging region being of a circular shape whose diameter is larger than the remainder of the housing. In use, the external ear engaging region is placed in the cavity or hollow of an external ear of the user.

However, if the housing were increased in size to accommodate an electroacoustic transducer of larger size for improved acoustic characteristics, then when the earphone is placed in the cavity of the external ear, it would impose pressure on a dimensionally small ear region between the tragus and an upper portion of the inlet of the external auditory meatus which is contiguous to the antitragus. Therefore, the size of the housing and hence the earphone itself is governed by the dimension between the tragus and the upper portion of the inlet of the external auditory meatus which is contiguous to the antitragus.

SUMMARY OF THE INVENTION

In view of the aforesaid problems, it is an object of the present invention to provide an earphone to be placed in the hollow or concha of an auricle, the earphone incorporating an electroacoustic transducer that is as large in diameter as possible for improved acoustic characteristics without imposing pressure on the user's ear.

According to the present invention, there is provided an earphone for use in the concha of the auricle of an ear having a tragus and an antitragus with an intertragus recess defined therebetween, and an external auditory meatus. The earphone comprises a case of a substantially elliptical shape having a major axis and a minor axis, the case being adapted to be supported between the tragus and the antitragus when placed in the concha. An electroacoustic transducer is housed in the case, and a leadout portion extends from the case to support a cord. The leadout portion has a diameter smaller than the major and minor axes of the case. The case and the leadout portion are shaped such that when the leadout portion is positioned in the inter-tragus recess, the minor axis of the case is aligned with a line segment interconnecting the antitragus and an upper edge of the inlet of the external auditory meatus of the ear above the tragus, and the major axis of the case is aligned with a line segment interconnecting the tragus and a wall portion of the concha opposite the tragus.

When the case of the earphone is put in the concha, the leadout portion is placed between and supported by the tragus and the antitragus, and the major axis of the case is oriented from the tragus and the wall portion of the concha opposite the tragus.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

DETAILED DESCRIPTION OF THE PREFERRED EMBODIMENT

Figure 1:
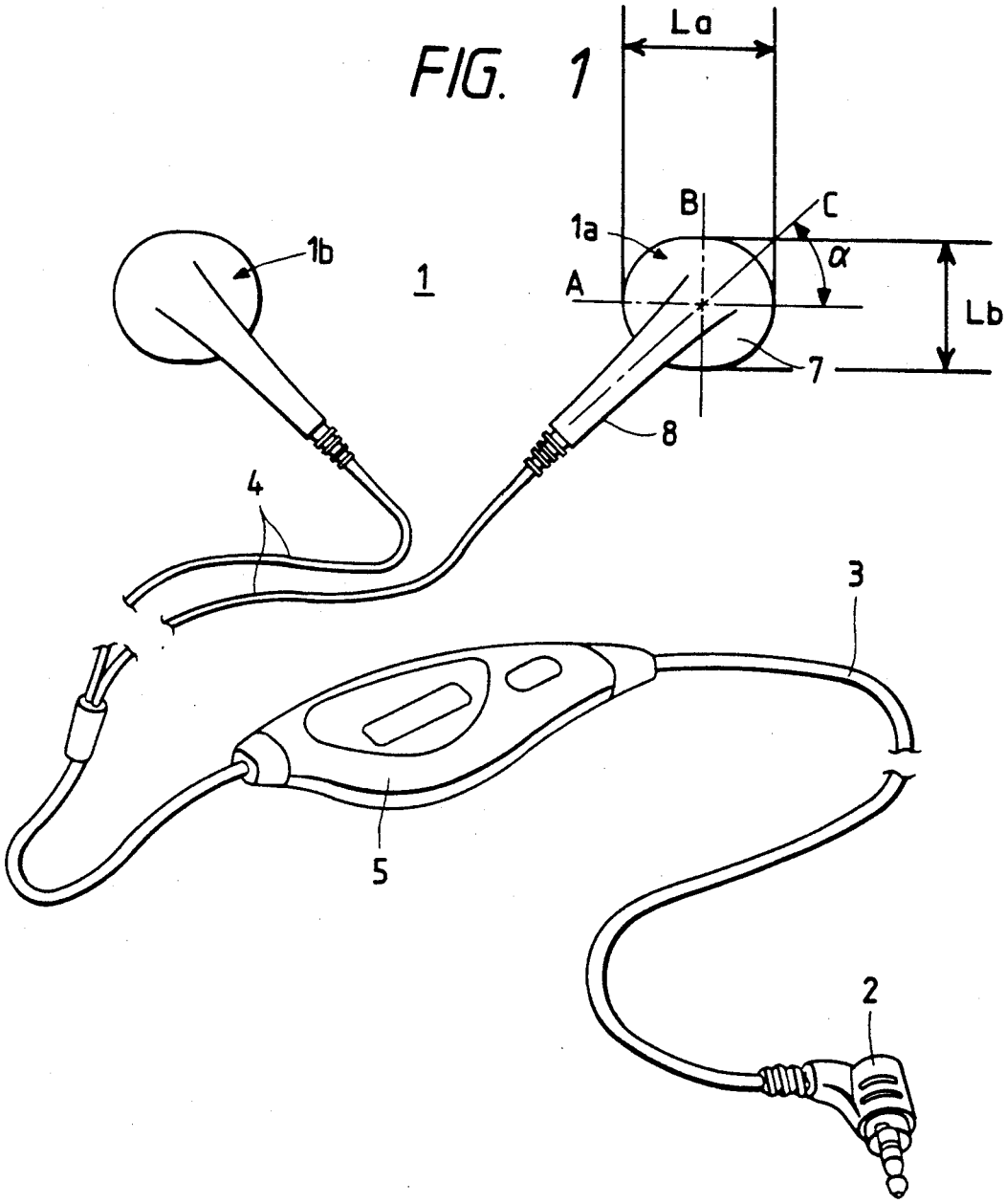
FIG. 1 is a perspective view of an earphone assembly according to the present invention.
Figure 2:
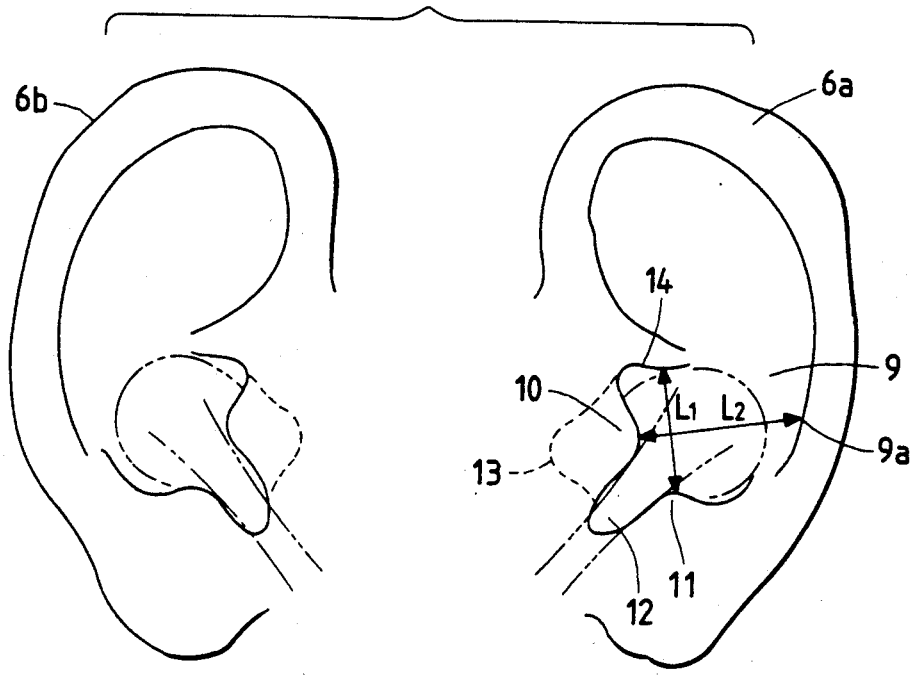
FIG. 2 is a view showing the manner the earphone assembly shown in FIG. 1 is used with ears.

As shown in FIG. 1, an earphone assembly has a lefthand earphone 1*a*, a righthand earphone 1*b*, a plug 2 to be connected to a reproducing device such as a tape recorder or the like, and a remote control unit 5 connected to the earphones 1*a*, 1*b* by respective cords 4 and to the plug 2 by a cord 3. When in use, the earphones 1*a*, 1*b* are placed respectively in the cavities or conchae 9 (see FIG. 2) of lefthand and righthand ear flaps or auricles 6*a*, 6*b*.

As shown in FIG. 1, each of the earphones 1*a*, 1*b* has a case 7 and a leadout portion 8 extending from the case 7. The case 7 is of a substantially elliptical shape having a major axis A having a size La that is the longer of the two axes with respect to which an ellipse is symmetric and a minor axis B having a size Lb that is the smaller of the two axes with respect to which an ellipse is symmetric. The leadout portion 8 is of an elongated shape whose diameter is much smaller than the major and minor axes A, B of the case 7. The leadout portion 8 has a longitudinal axis C that is inclined at an angle $\alpha$ with respect to the major axis A of the case 7. The angular displacement $\alpha$ of the axis C from the major axis A on the lefthand earphone 1*a* is opposite to that on the righthand earphone 1*b* such that the lefthand and righthand earphones 1*a*, 1*b* are symmetrical in shape as shown in FIG. 1. The angle $\alpha$ is selected on the basis of the configuration of the lefthand and righthand auricles 6*a*, 6*b*, and is in the range of from 40 to 60 degrees, preferably about 50 degrees.

As shown in FIG. 1, the lefthand and righthand auricles 6*a*, 6*b* are substantially symmetrical in shape, and each have a hollow or concha 9, a tragus 10, an antitragus 11, a recess 12 between the tragus 10 and the antitragus 11, i.e., an inter-tragus recess, and an external auditory meatus 13 disposed behind the tragus 10 and extending from the concha 9 into the head.

When each earphone is used, as shown in FIG. 1, the case 7 thereof is placed on the concha 9 and supported between the tragus 10 and the antitragus 11, with the leadout portion 8 positioned in and extending along the intertragus recess 12. The antitragus 11 is spaced by a distance L1 from an upper edge 14 of the inlet of the external auditory meatus 13 above the tragus 10, and the tragus 10 is spaced by a distance L2 from a wall portion 9*a* of the concha 9 opposite the tragus 10. The distance L2 is larger than the distance L1. The angle $\alpha$ (FIG. 1) of the axis C with respect to the major axis A is determined depending on the difference between the dimensions L1, L2. More specifically, the case 7 and the leadout portion 8 are shaped such that when the leadout portion 8 is positioned in the inter-tragus recess 12, the minor axis B extends between, i.e., aligns with a line segment interconnecting, the antitragus 11 and the upper edge 14, and the major axis A extends between, i.e., aligns with a line segment interconnecting, the tragus 10 and the wall portion 9*a*.

Figure 3:
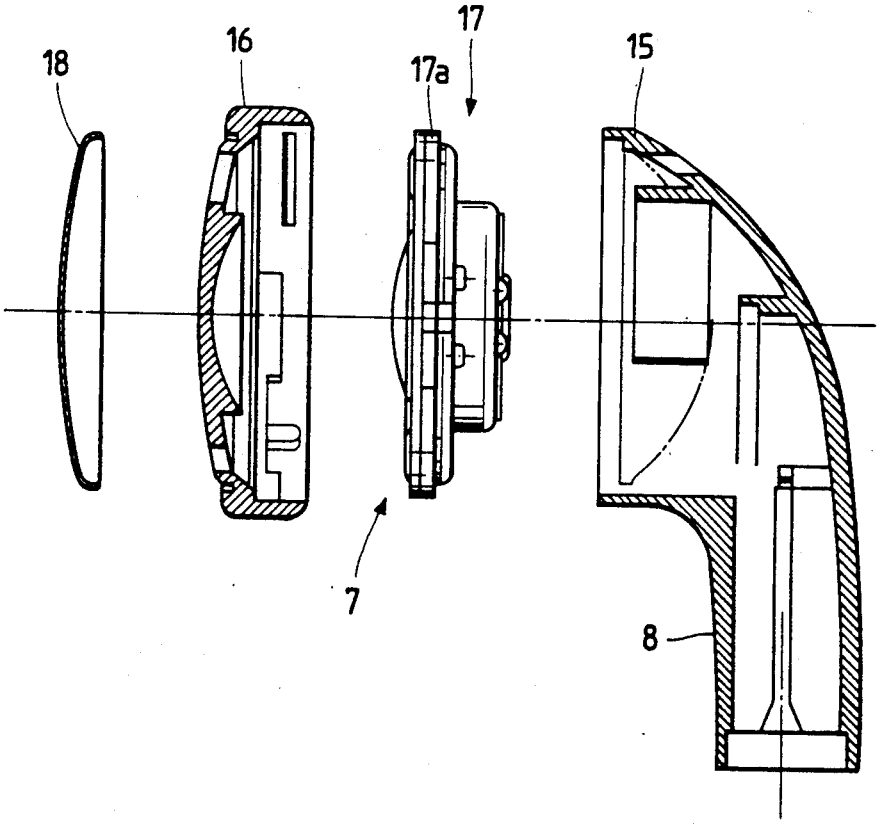
FIG. 3 is an enlarged exploded cross-sectional view of an earphone of the earphone assembly shown in FIG. 1.

FIG. 3 shows the case 7 in exploded cross section. The case 7 comprises a case body 15 from which the leadout portion 8 extends, a front case member 16, and an electroacoustic transducer 17 interposed between the case body 15 and the front case member 16. The front face of the front case member 16 is covered with a protective net 18. The case body 15 and the front case member 16 have an elliptical outer shape. The electroacoustic transducer 17 includes a frame 17*a* which has a circular outer circumferential shape, as shown in FIG. 4.

The frame 17*a* has on its outer circumferential edge a pair of radially outward engaging teeth 19 with a recess 20 defined therebetween, and a pair of radially outward engaging teeth 21 with a lead wire slot 22 defined therebetween, the engaging teeth 21 being substantially diametrically opposite to the engaging teeth 19.

Figure 5:
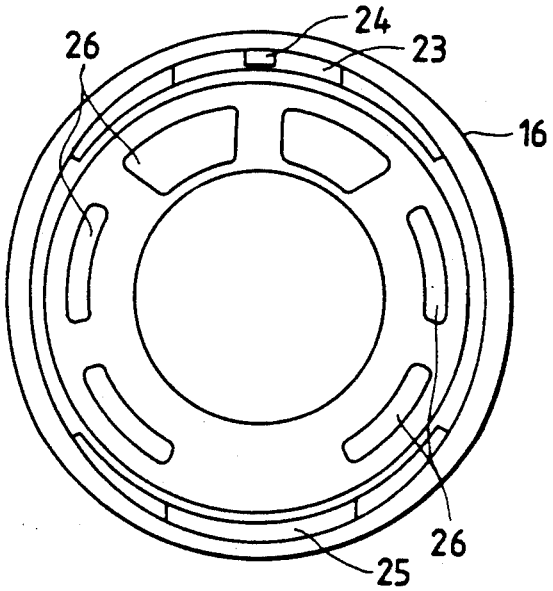
FIG. 5 is a rear elevational view of a front case member of the earphone.

As shown in FIG. 5, the front case member 16 has on its outer circumferential edge a recess 23 for receiving the engaging teeth 19, an engaging rib 24 disposed centrally in the recess 23 for engaging in the recess 20, and a recess 25 diametrically opposite to the recess 23 for receiving the engaging teeth 21. The front case member 16 also has a plurality of circumferentially spaced holes 26 for radiating sound therethrough from the electroacoustic transducer 17.

Figure 4:
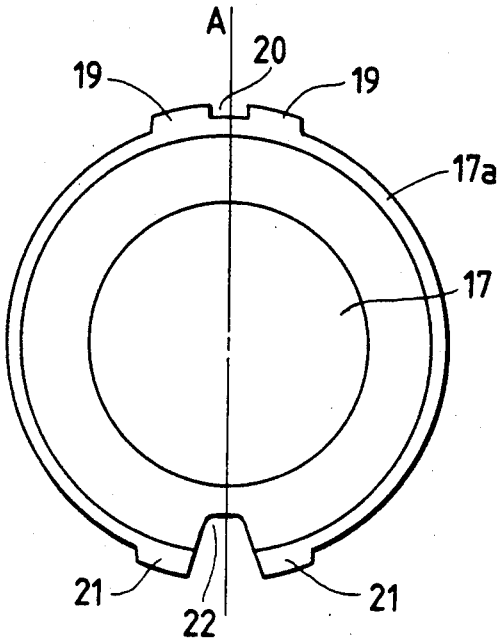
FIG. 4 is a front elevational view of a frame of an electroacoustic transducer of the earphone.

As shown in FIG. 4, the engaging teeth 19 and the engaging teeth 21 are diametrically spaced from each other along the major axis A of the case 7. Consequently, the dimension of the case 7 along the minor axis B thereof can be reduced substantially to the diameter of the frame 17*a* of the electroacoustic transducer 17.

The case 7 of the above dimensions does not impose excessive pressure on the user's ear when placed in the concha 9, so that the user does not feel uncomfortable in the use of the earphone. Since the diameter of the frame 17*a* of the electroacoustic transducer 17 may be substantially the same as the dimension of the case 7 along the minor axis B thereof, the size of the electroacoustic transducer 17 may be as large as possible within the case 7. Accordingly, the earphone according to the present invention provides good acoustic characteristics.

Although a certain preferred embodiment of the present invention has been shown and described in detail, it should be understood that various changes and modifications may be made therein without departing from the scope of the appended claims.

We claim as our invention:

1. An earphone for use in the concha of the auricle of an ear having a tragus, an antitragus, an inter-tragus recess defined between said tragus and said antitragus, and an external auditory meatus, said earphone comprising:

a substantially elliptical shaped case having a major axis that is the longer of the two axes with respect to which an ellipse is symmetric and a minor axis that is the smaller of the two axes with respect to which an ellipse is symmetric, said case being adapted to be supported between the tragus and the antitragus when placed in the concha;

an electroacoustic transducer housed in said case;

a leadout portion extending from said case for supporting a cord, said leadout portion having a diameter smaller than the major and minor axes of said case, said leadout portion being of an elongated shape having a longitudinal axis inclined with respect to the major axis of said case; and said case and said leadout portion being shaped such that when said leadout portion is positioned in the inter-tragus recess, said minor axis of the case is aligned with a line segment interconnecting the antitragus and an upper edge of the inlet of the external auditory meatus of the ear above the tragus, and said major axis of the case is aligned with a line segment interconnecting the tragus and a wall portion of the concha opposite the tragus.

2. An earphone according to claim 1, wherein said electroacoustic transducer includes a frame of a circular outer circumferential shape, said frame having on an outer circumferential edge thereof radially outward engaging teeth for engaging said case, said radially outward engaging teeth being diametrically opposite to each other along the major axis of said case.

3. An earphone according to claim 2, wherein said frame of the electroacoustic transducer has a diameter which is substantially the same as the dimension of said case along the minor axis thereof.

4. An earphone according to claim 1, wherein said longitudinal axis is inclined to said major axis of the case at an angle ranging from 40 to 60 degrees.

5. An earphone according to claim 4, wherein said angle is approximately 50 degrees.

6. An earphone assembly for use in the conchae of the auricles of ears each having a tragus and an anti-tragus with an inter-tragus recess defined therebetween, and an external auditory meatus, said earphone assembly comprising a pair of earphones each for use in a respective concha, each of said earphone comprising:

a substantially elliptical shaped case having a major axis that is the longer of the two axes with respect to which an ellipse is symmetric and a minor axis that is the smaller of the two axes with respect to which an ellipse is symmetric, said case being adapted to be supported between the tragus and the antitragus when placed in the concha;

an electroacoustic transducer housed in said case;

a leadout portion extending from said case for supporting a cord, said leadout portion having a diameter smaller than the major and minor axes of said case, said leadout portion being of an elongated shape having a longitudinal axis inclined with respect to the major axis of said case;

said case and said leadout portion being shaped such that when said leadout portion is positioned in the inter-tragus recess, said minor axis of the case is aligned with a line segment interconnecting the antitragus and an upper edge of the inlet of the external auditory meatus of the ear above the tragus, and said major axis of the case is aligned with a line segment interconnecting the tragus and a wall portion of the concha opposite the tragus; and said cases and leadout portions of said earphones being symmetrical in shape.

7. An earphone assembly according to claim 6, wherein said electroacoustic transducer includes a frame of a circular outer circumferential shape, said frame having on an outer circumferential edge thereof radially outward engaging teeth for engaging said case, said radially outward engaging teeth being diametrically opposite to each other along the major axis of said case.

8. An earphone assembly according to claim 7, wherein said frame of the electroacoustic transducer has a diameter which is substantially the same as the dimension of said case along the minor axis thereof.

9. An earphone assembly according to claim 6, wherein said longitudinal axis is inclined to said major axis of the case at an angle ranging from 40 to 60 degrees.

10. An earphone according to claim 9, wherein said angle is approximately 50 degrees.

* * * * *